United States Patent [19]

Spiegelberg

[11] 4,143,762

[45] Mar. 13, 1979

[54] WET-TISSUE RACK

[75] Inventor: Hans Spiegelberg, Täby, Sweden

[73] Assignee: Salve S.A., Fribourg, Switzerland

[21] Appl. No.: 329,967

[22] Filed: Feb. 6, 1973

[30] Foreign Application Priority Data

Feb. 22, 1972 [SE] Sweden ..... 2119/72

[51] Int. Cl.[2] ..... B65D 81/22; B65D 83/00; B65D 85/62

[52] U.S. Cl. ..... 206/210; 206/494; 221/47; 221/63

[58] Field of Search ..... 206/494, 210; 221/48, 221/46, 47, 63, 55; 220/24 R, 339

[56] References Cited

U.S. PATENT DOCUMENTS

| | | | |
|---|---|---|---|
| 1,983,139 | 12/1934 | Lovell | 220/24 R |
| 2,079,052 | 5/1937 | Tamini | 220/24 R |
| 3,116,927 | 1/1964 | Kuhlman | 220/24 R |
| 3,239,097 | 3/1966 | Bates et al. | 221/48 |
| 3,325,003 | 6/1967 | Bilezerian | 221/46 |
| 3,499,575 | 3/1970 | Rockefeller | 221/55 |
| 3,684,086 | 8/1972 | Harrison | 206/494 |
| 3,819,043 | 6/1974 | Harrison | 206/449 |

*Primary Examiner*—William T. Dixson, Jr.

[57] ABSTRACT

A storage box for wet-tissues arranged in a stack in said box. The box is provided in its upper surface with an opening, which normally is closed by a tongue-shaped sealing member being attached to one end of the upper surface of the box and having such length and breadth that a substantially moisture-tight seal is provided.

20 Claims, 3 Drawing Figures

WET-TISSUE RACK

The present invention relates to a wet-tissue pack in the form of a storage box to carry a plurality of moistened, so-called wet-tissues.

The invention can be used with advantage for cleansing tissues, by which is meant so-called wet-tissues used, inter alia, for personal hygiene, particularly when soap and water are not available. Such a tissue usually consists of a cloth of paper or unwoven material, normally inpregnated with a cleansing, antiseptic solution containing a mild cleansing component, a component to return oil to the skin thus preventing it from drying out, and a bactericidal substance. It may also contain a perfume. The wet-tissues which, as the name suggests, should be used when moist, are packed individually in a moisture-proof casing such as aluminium foil so that they can retain their moisture up to the time of use. They are usually sold in an outer package which is not moisture-proof and normally holds ten wet-tissues packed individually in moisture-proof wrappings. Such a multiple pack guarantees that each individual wet-tissue retains its moisture to the time of use, but it is expensive for the consumer. Of course the pack may be used for wet-tissues intended for purposes other than hygiene.

The object of the present invention is to produce a tissue pack which, taken on the cost of each wet-tissue in the pack, is cheaper for the consumer without noticeably reducing the requirements concerning moisture being retained until the moment of use. This is made possible by taking a cleansing tissue pack of the type described in the introduction of the specification and giving it the characteristics specified in the characterising part of claim 1.

Figure 1:
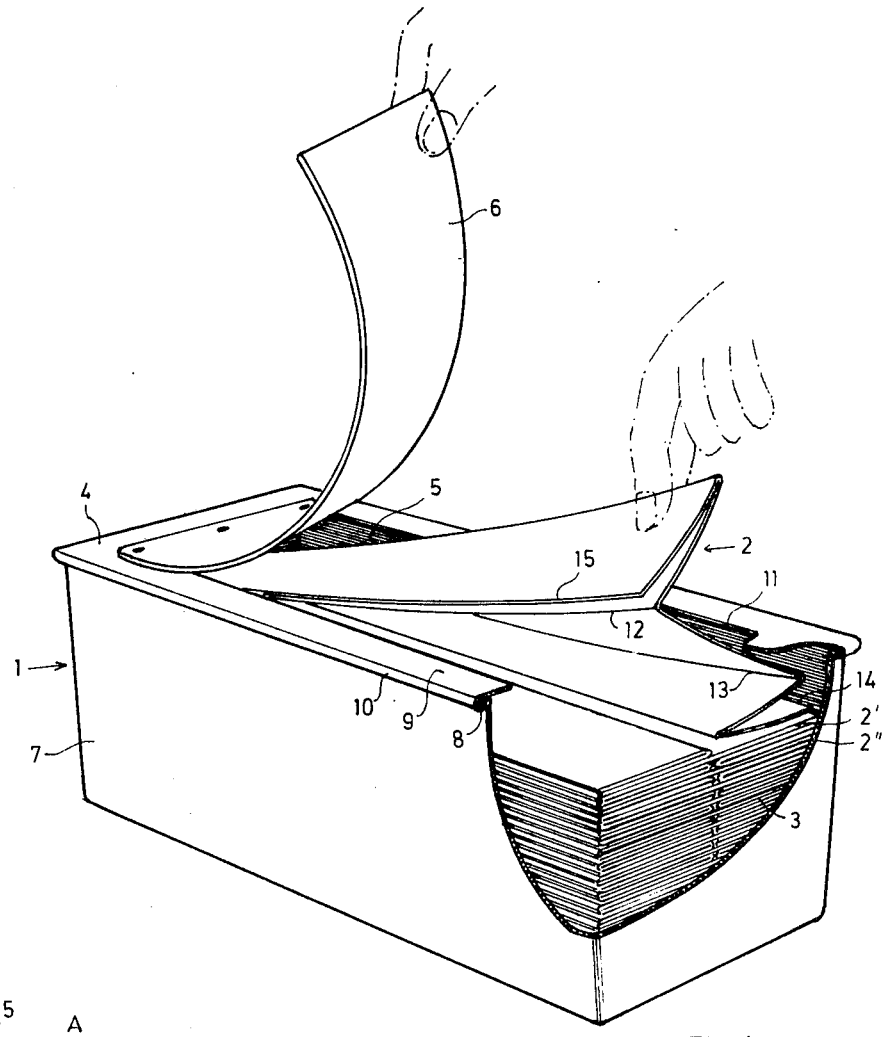
Figure 2:
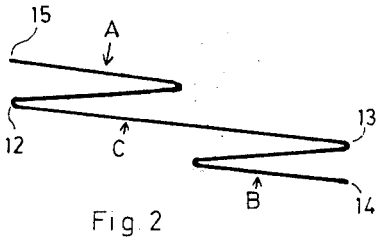
Figure 3:
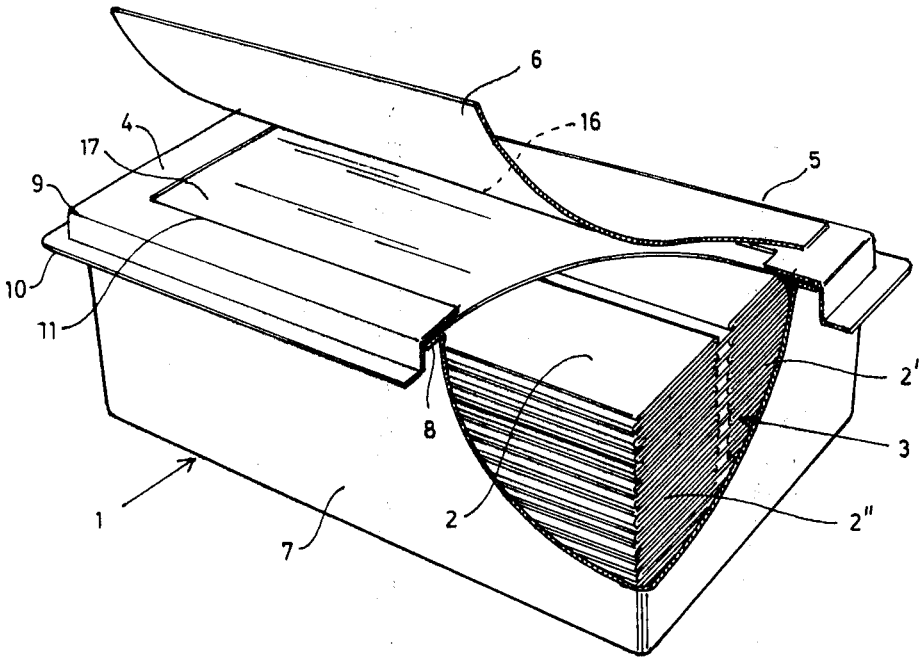

For a better understanding of the invention, reference may be had to the following description of exemplary embodiment, taken in conjunction with the accompanying drawings, in which FIG. 1 is a perspective view of a preferred embodiment of the pack with an upper corner removed for the sake of clarity, FIG. 2 is a diagram showing in principle how the tissue is folded and FIG. 3 shows another embodiment of the invention.

The cleansing tissue pack shown in the drawing comprises a parallel-epipedic box 1 of moisture-proof material and a plurality of moistened wet-tissues 2, 2', 2" packed in the box, which abut each other in direct contact to form a stack 3. The moisture-proof material preferably consists of a diffusion-tight plastic which is inert to the components of the moisturizing solution.

The wet-tissues may consist, for example, of paper cloths or cloths of non-woven material which, if they are to be used as cleansing tissues, are impregnated with a cleansing, antiseptiv solution, usually of about 15% ethanol solution containing a bactericide, such as trichlorohydroxyphenylether or cetypyridine chloride, and a component reducing surface tension, for example an amphoteric tenside. The solution may also contain substances beneficial to the skin, such as lanolin and isopropylmyristat and perfume elements such as methanol.

The box 1 is provided in its upper surface 4 with an opening 5 which is normally tightly sealed by means of a substantially tongue-shaped sealing member 6, also consisting of moisture-proof material. In order during the manufacture of the pack to facilitate the insertion of a stack of wet-tissues into the box, this is suitably provided with a drawer-part 7 as shown in the drawing, having a turned-back edge 8, and a lid 9 with a folded edge 10 which is snapped over the edge 8 so as to be moisture-tight. The opening 5 is thus arranged in the lid 9 and the tongue-shaped sealing member 6 is attached at one end to the upper surface 4 of the lid and is of such length and breadth that it covers the opening 5. At least the section of the sealing member 6 which abuts the edge zone 11 limiting the opening 5 when the box 1 is closed consists of an elastomeric sealing material such as rubber. Furthermore, the sealing member 6 is constructed so that it is sufficiently heavy to form the sealing material so that a substantially moisture-tight seal is obtained when the sealing member 6 abuts the edge 11 of the opening. The opening 5 can thus be exposed by lifting the free end of the sealing member 6 and re-sealed by lowering said free end.

In the embodiment shown in FIG. 1 the sealing member 6 consists of a tongue-shaped rubber sheet which is stapled or glued at one end to the lid 9. The rubber sheet 6 is of such a thickness that it is sufficiently heavy to provide a seal against the edge 11 and also to be self-carrying over the opening 5. A rubber sheet having a thickness of around 3 - 4 mm fulfils these requirements. However, the requirements can also be fulfilled by other designs for the sealing member. In another embodiment, for example, the rubber sheet 6 is thinner and is provided on its lower side with a reinforcing member of suitable weight which fits in the opening 5. Such a reinforcing member may suitably consist of a stiff plastic sheet stapled or attached in some other way to the rubber sheet. The reinforcing member may equally well be applied to the upper side of the rubber sheet and in this case it is preferably the same width as this for aesthetic reasons. However, it must be somewhat shorter than the rubber sheet so that this may act as a hinge at the attaching end. In the latter case, the rubber sheet may be replaced, if desired, by a rectangular frame of rubber, one short side of which has such a width, seen along the long side of the rectangle, that the rubber frame can be attached to the lid of the box and act as a hinge.

As can be seen from the embodiment shown in FIG. 3, the sealing member 6 is attached to the upper surface of the box 1 by one long side 16 and suitably consists of a relatively stiff plastic material having a thickness of a few millimeters. In this embodiment the box opening 5 is moisture-proof and sealed by a tear-off foil 17 of aluminium, plastic or some other material having similar properties, during storage and transport, i.e. before the first tissue has been removed from the box.

The drawings show an embodiment of the cleansing tissue pack according to the invention, which is particularly attractive to the customer. In this embodiment the opening 5 is located centrally in the lid 9. Furthermore, the wet-tissues, which have a width slightly less than three times the internal width of the box and a length negligibly less than the internal length of the box, are suitably folded in a special manner which makes it extremely easy for the consumer, after lifting the free end of the sealing member, to take hold of a wet-tissue and lift it out of the box. Each tissue is folded — as can be seen clearly in FIG. 2 — so that initially it is imagined to be folded along the folding lines 12, 13, this producing three layers A, B and C, one above the other. The free edge 14 of the lower layer B is then folded back to alignment with the fold 13 and the free edge 15 of the upper layer A is folded back to alignment with the fold 12. A tissue folded in this way is extremely easy to take hold of and saves space. Thus a tissue is obtained which, in the cross-section shown, has two substantially Z-shaped sections on each side of the central plane C of the tissue. Alternatively, the tissue may be folded so that both the Z-shaped sections are located on the same side of the central plane C.

In order to ensure that the wet-tissues do not lose any moisture during the time from manufacturing the cleansing tissue pack to the moment when the first wet-tissue in the pack is to be used, it is advisable for no leakage whatsoever to be able to occur between the sealing member 6 and the edge 11 of the opening. Although it would be possible to use adhesive material to keep the sealing member 6 in continuous contact with the lid 9 during transport and storage, mechanical means are preferred to keep the sealing member pressed against the edge 11 of the opening. As examples of preferred mechanical means may be mentioned a plastic foil which extends over the sealing member 6 and is welded to the box, and a shrunk foil surrounding the pack.

I claim:

1. A wet tissue dispenser comprising a package of a moisture-proof material adapted to maintain a plurality of folded tissues in a stack therein, an opening formed in one wall of said package, a sealing member attached along one portion thereof to the outer surface of said wall, said sealing member being movable with respect to said attached portion to enable exposure of said opening and having an inherent resiliency and a length, breadth and weight to automatically close said opening on being released to normally provide a moisture-tight seal with said wall about said opening.

2. The dispenser according to claim 1 wherein said opening is spaced from the edges of said wall to provide a peripheral surround continuous border, said sealing member comprising a flexible sheet hingedly connected to said wall and having a conforming size to overlap said surrounding continuous border when closing said opening to maintain the tissues remaining in said package free of exposure.

3. The dispenser according to claim 2 wherein said sheet material is a foil of relatively stiff plastic material.

4. The dispenser according to claim 2 wherein said sheet material is elastomeric.

5. The dispenser according to claim 4 wherein said elastomeric sheet material is rubber and has a thickness of about 3–4 mm.

6. The dispenser according to claim 1 wherein said package is substantially parallelepied and its top wall is provided with said opening, said opening and said sealing member being substantially rectangular in shape, said sealing member being attached to said top wall along one edge thereof.

7. The dispenser according to claim 1 where at least the peripheral border of said sealing member, adapted to overlap the peripheral edges of said opening, is provided with an easily deformable material adapted to contact said peripheral edge and conform to the surface thereof.

8. The dispenser according to claim 1 including means for removably securing said sealing member to said one wall, in moisture-tight condition about its entire periphery.

9. The dispenser according to claim 8 wherein said means for removably securing said sealing member about its entire periphery comprises an outer wrapper adapted to overlie at least said seal member and said opening and being sealed in moisture-tight relationship to said package.

10. The dispenser according to claim 1 wherein each of said tissues is folded to form in cross section a substantially planar center portion having two substantially Z-shaped sections along each edge thereof.

11. The dispenser according to claim 10 wherein the Z-shaped sections are located above the same surface of the center planar section.

12. The dispenser according to claim 10 wherein the Z-shaped sections are located on opposite surfaces of said planar center section.

13. The dispenser according to claim 10 wherein each of said tissues forming said stack are folded individually from a flat sheet along fold lines forming three layers located one on top of the other, the free edge of the lower layer being folded back into alignment with its associated fold and the free edge of the upper layer being folded back into alignment with its associated fold.

14. A dispenser for pre-moistened edge folded towelettes comprising a container having a top, an opening in the top, towelettes therein being arranged each to present an exposed edge transversely of the opening, a flexible flap having an edge secured to the container adjacent the opening, said flap being free-ended and being of a material tending to maintain a planar position on the container top in contact therewith, said flap being of greater extent than the opening, covering the opening and overlapping all the edges thereof, the unsecured portion of the flap being displaceable to give access to the opening.

15. The dispenser of claim 14 wherein the flap is hinged to the container.

16. The dispenser of claim 14 wherein the opening has a longer dimension transverse to the exposed edges of the towelettes than its dimension parallel to the edges of the towelettes.

17. The dispenser of claim 16 wherein the flap is secured to the container in a position to flex on an axis at right angles to the larger dimension of the opening.

18. The dispenser of claim 16 wherein the secured edge of the flap is adjacent an end of the opening on the longer dimension, the secured edge of the flap being generally parallel to the shorter dimension of the opening.

19. A dispenser for pre-moistened separate towelettes comprising a tray, a cover therefor, an opening in the cover having a longer dimension and a shorter dimension, a flexible flap greater in extent than the opening and secured to the cover adjacent the opening along an edge of the flap that is perpendicular to the longer dimension of the opening and normally overlying the opening and overlapping all the edges thereof, the flap being of a material that yields to uncover the opening but maintains planar contact with the cover about the opening when released.

20. The dispenser of claim 19 wherein the towelettes are arranged to present successive edges intersecting the opening along lines extending across the shorter dimension of the opening.

* * * * *

UNITED STATES PATENT AND TRADEMARK OFFICE

CERTIFICATE OF CORRECTION

PATENT NO. : 4,143,762

DATED : March 13, 1979

INVENTOR(S) : HANS SPIEGELBERG

It is certified that error appears in the above-identified patent and that said Letters Patent are hereby corrected as shown below:

On the cover sheet [54] change to read -- WET-TISSUE PACK--

Col.1, line 2 (Title) change to read -- WET-TISSUE PACK --

Signed and Sealed this

*Twelfth* Day of *June 1979*

[SEAL]

*Attest:*

RUTH C. MASON
*Attesting Officer*

DONALD W. BANNER
*Commissioner of Patents and Trademarks*